United States Patent [19]

Manning

[11] Patent Number: 4,631,388

[45] Date of Patent: Dec. 23, 1986

[54] OFF-PEAK ELECTRIC LIQUID HEATING SYSTEM EMPLOYING REGULATABLE HEAT PIPE

[75] Inventor: Howard J. Manning, Cambridge, England

[73] Assignee: TI Domestic Appliances Limited, London, England

[21] Appl. No.: 668,948

[22] Filed: Nov. 7, 1984

[30] Foreign Application Priority Data

Nov. 8, 1983 [GB] United Kingdom ..... 8329740

[51] Int. Cl.[4] ..... F24H 7/00; H05B 1/00; F28D 15/02

[52] U.S. Cl. ..... 219/326; 165/10; 165/32; 165/104.11; 219/275; 219/302; 219/341; 219/365; 219/378; 219/530

[58] Field of Search ..... 219/325, 326, 302, 275, 219/365, 378, 530, 540, 341; 165/10 A, 32 H, 104.11 A, 104.26

[56] References Cited

U.S. PATENT DOCUMENTS

| | | | |
|---|---|---|---|
| 2,911,513 | 11/1959 | MacCracken | 219/341 X |
| 3,602,429 | 8/1971 | Levedahl et al. | 165/104.26 |
| 3,854,454 | 12/1974 | Lazaridis | 219/341 X |
| 3,911,683 | 10/1975 | Wolf | 219/341 X |
| 3,991,936 | 11/1976 | Switzgable | 219/365 X |
| 4,119,143 | 10/1978 | Robinson | 165/10 A |
| 4,131,158 | 12/1978 | Abhat et al. | 165/104.11 A |

FOREIGN PATENT DOCUMENTS

| | | | |
|---|---|---|---|
| 1322119 | 2/1963 | France | 219/325 |
| 1434485 | 2/1966 | France | 219/326 |
| 75184 | 6/1980 | Japan | 165/104.11 A |
| 37492 | 4/1981 | Japan | 165/32 H |
| 690275 | 10/1979 | U.S.S.R. | 165/32 H |

*Primary Examiner*—A. Bartis

*Attorney, Agent, or Firm*—Solon B. Kemon

[57] ABSTRACT

A liquid heating system, for example a central heating system, including a heat store in the form of a stack of bricks heated to a relatively high temperature by electric heating elements embedded in the bricks and energized by off-peak electricity is thermally connected to a vessel containing the liquid to be heated by a controllable heat pipe. The heat pipe includes an evaporator zone in thermal contact with the heat store and a condenser zone in thermal contact with the vessel, which could be a water tank. The zones are joined by at least one duct to form a hermetically sealed unit containing a small quantity of a volatile liquid which, in use, is a totally evaporated in the evaporator zone so that the rate of heat transfer to the condenser zone from the evaporator zone is determined by the return flow rate of condensed volatile liquid to the evaporator zone. A return flow control device responsive to the pressure within the condenser zone is provided for controlling the return flow rate of the condensed volatile liquid to the evaporator zone.

12 Claims, 5 Drawing Figures

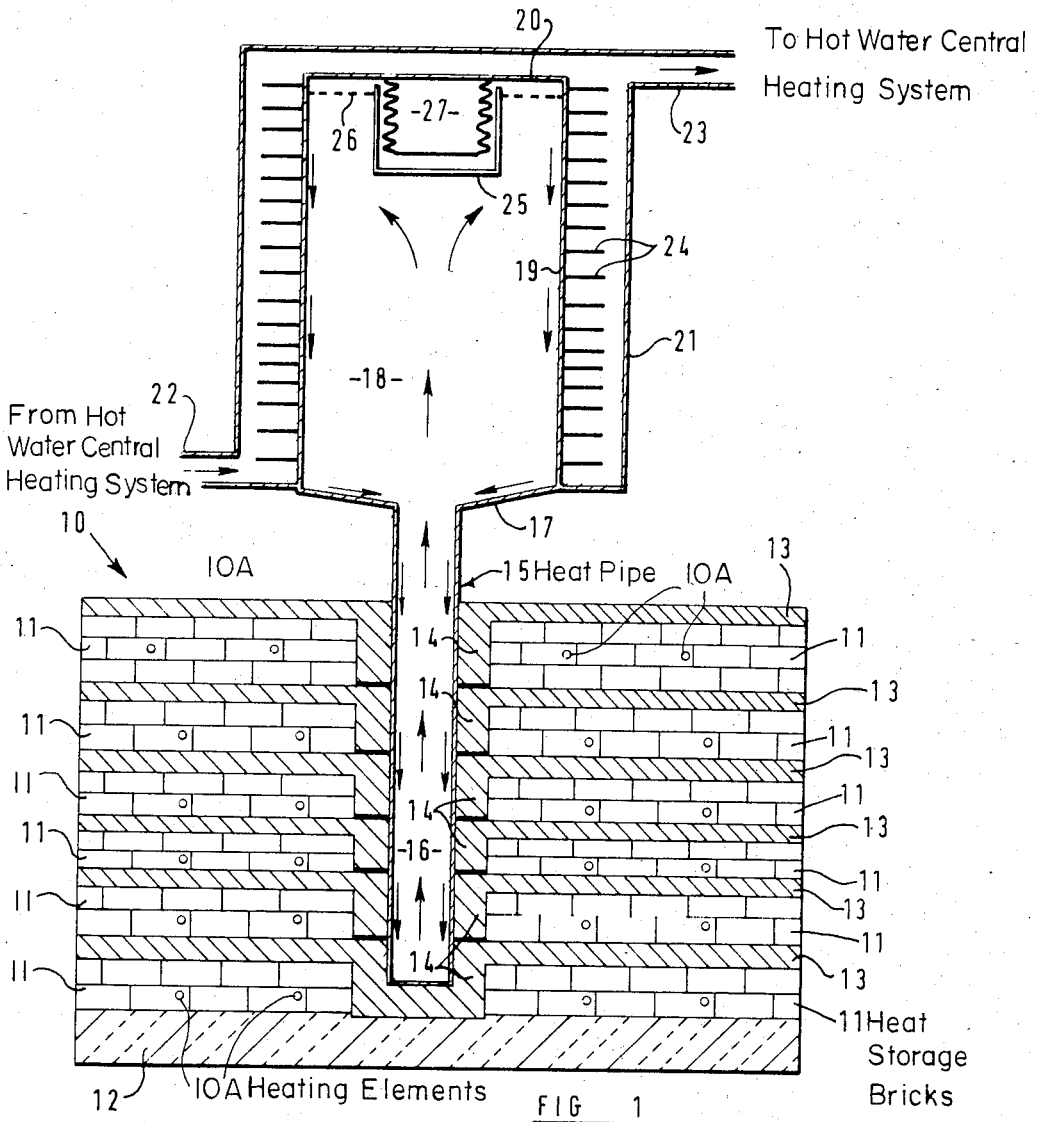
FIG 1
FIG. 1A
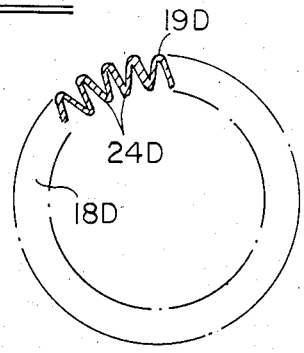

OFF-PEAK ELECTRIC LIQUID HEATING SYSTEM EMPLOYING REGULATABLE HEAT PIPE

This invention relates to liquid heating systems and is applicable particularly, but not exclusively, to the use of a heat pipe for the transfer of heat from an off-peak electrically heated store to a supply of water.

According to one aspect of the invention, there is provided a liquid heating system, for heating a first liquid, including a heat store to be heated to a relatively high temperature by off-peak electricity thermally connected by a heat pipe to a vessel to contain the first liquid which is to be heated to a temperature lower than said relatively high temperature, the heat pipe including an evaporator zone in thermal contact with the heat store and a condenser zone in thermal contact with the vessel, the zones joined by one or more ducts, the evaporator zone, condenser zone and the duct or ducts being hermetically sealed and containing a predetermined quantity of a volatile second liquid, arranged so that after the second liquid is evaporated in the evaporator zone, it passes through the duct or one of the ducts to the condenser zone where it is condensed, and from whence the second liquid returns to the evaporator zone through the duct or through another of the ducts, the quantity of second liquid being chosen to be sufficiently small so that, in use, the rate of heat transfer from the evaporator zone to the condenser zone is determined by the rate of return flow of the second liquid toward the evaporator zone rather than the rate of flow of the evaporated second liquid towards the condenser zone, or the heat transfer to the evaporator zone or from the condenser zone.

Conveniently the liquid heating system includes control means arranged to collect a predetermined volume of the second liquid, said volume being variable in response to the pressure or temperature within the heat pipe, so as to reduce the amount of second liquid circulating in the heat pipe as the pressure or temperature therein rises. Preferably the liquid heating system includes reservoir means positioned to collect said second liquid up to a predetermined level, and means to alter the volume of the second liquid in the reservoir means in response to changes in pressure or temperature in the heat pipe.

The heat store may comprise a mass of solid material to be heated by an electrical resistance element, for example bricks. Furthermore, there may be metal fins in thermal contact with the evaporator zone, the fins extending among the solid material. Such fins may be cast iron plates.

Preferably the outside of the condenser zone, within the vessel, is provided with heat exchange fins, corrugations or other heat exchange surfaces.

The wall of the condenser zone above the reservoir may be of downwardly convergent shape, whereby condensate forming thereon will run down and drop into the reservoir.

Conveniently the reservoir means includes a sealed capsule which contracts in volume as the pressure in the condenser rises.

The liquid heating system may include a valve means arranged to constrict the flow of the evaporated second liquid along the duct as the temperature or pressure in the condenser increases.

The first liquid may be water and the vessel may be connected into a hot water central heating system.

The invention is described, by way of example only, with reference to the accompanying drawings, in which:

FIG. 1 is a diagrammatic sectional view in a vertical plane of one embodiment of the invention, FIG. 1A is a diagrammatic cross-sectional view of an alternative construction of the condenser shown in FIG. 1.

Figure 2:
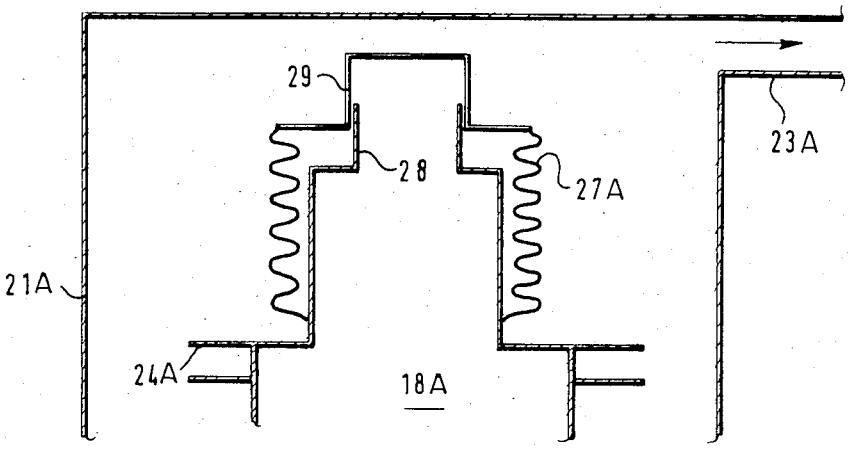
FIG. 2 is a section showing an alternative to part of FIG. 1.

FIG. 1 shows, in diagrammatic form, one embodiment of the invention in which heat is extracted from an off-peak electrically heated store 10 and transferred to water circulating through a system, such as a domestic central heating installation. The heat store 10 comprises a rectangular stack of bricks 11 embedded in which are electrical resistance heating elements, shown schematically at 10A in known manner. Normally, electricity is used to heat up the bricks 11 at a time when electricity can be purchased cheaply and heats up the bricks 11 over a period of hours. The whole of the heat store 10 is surrounded by insulation, which is unshown apart from the base portion 12.

Heat transfer through the bricks 11 is assisted by horizontally extending plates 13 having a higher thermal conductivity than the bricks and aligned central bosses 14 through which a vertical heat pipe 15 is fitted. The heat pipe 15 is not necessarily attached to the bosses 14 but is at least a close fit thereto, so as to ensure good heat transfer. Heat is conducted through the bricks 11 for a relatively short distance to the nearest plate 13. It then passes inward along the plates 13 to the bosses 14 and hence into the heat pipe 15.

The heat pipe 15 comprises a vertical hermetically sealed evaporator tube 16, closed at its base and opening at the top through the downwardly sloping base 17 of a condenser 18, which has a cylindrical wall 19 and top wall 20.

The condenser 18 is immersed in a water tank 21, having an inlet pipe 22 and outlet pipe 23.

In a typical domestic central heating system, water is pumped through the inlet pipe 22, through the tank 21 and out through the pipe 23 to the radiators in various rooms. To assist heat transfer from the condenser wall 19, it is formed with heat exchange fins 24, or other appropriate heat exchange surfaces such as corrugations 24D, FIG. 1A, which depicts diagrammatically a cross-sectional plan view of a condenser 18D having a wall 19D in which the corrugations 24D are formed, in the water of the tank 21.

The heat pipe 15 is generally evacuated apart from a few cc of an appropriate volatile liquid, such as water, so that the interior of the heat pipe 15 contains water and water vapour only. In use, heat from the bricks 11 heats the wall of the evaporator 16 and evaporates the water which rises up the centre of the evaporator 16 and into the condenser 18, where it condenses on the walls thereof and runs, as shown by the arrows, back down the walls of the evaporator 16, where it is re-evaporated, thus forming a continuous cycle. This principle of the heat pipe 15 is well known and enables high rates of heat transfer to be made between the evaporator 16 and the condenser 18.

The temperature of the bricks 11 will rise during the period in which electricity is supplied thereto, reaching a maximum of some hundreds of degrees centigrade, from which it falls during the period when heat is being extracted. Thus, the potential heat supply to the evaporator 16 varies with time.

Similarly, the water passing out of the tank 21 to the pipe 23 will normally be required at a temperature somewhat below 100 degrees C. although the temperature of the water entering through the pipe 22 may vary from cold up to nearly the temperature of the outgoing water through the pipe 23, depending on the amount of heat extracted through the rest of the central heating system On some occasions, the pump may be stopped so that little water flows through the tank 21. In the circumstances, there may well be a mis-match between the heat fed into the evaporator 16 and that removed by the water through by the pipe 23. Particularly, there may well be a tendency for the water in the tank 21 to boil unacceptably.

This situation is alleviated by the automatic control of the rate at which heat is transferred up the heat pipe 15. In the condenser 18 there is provided an open topped reservoir 25 rigidly located from the condenser 18 by structure 26. An evacuated bellows capsule 27 is fastened within the reservoir 25. As the pressure of vapour in the condenser 18 rises and falls it will cause the capsule 27 to shorten and lengthen respectively.

Over a short period of time the heat input to the evaporator 16 from the bricks 11 and plates 13 will tend to remain substantially constant, whereas if the water passing through the pipe 23 is reduced in flow or increased in temperature, the heat removed by the water leaving through the pipe 23 will be reduced. In this situation the temperature of the vapour in the evaporator 16 and condenser 18 will tend to rise, and the vapour pressure therein will also rise, and thus, the capsule 27 will shorten. In normal operation, the cooling of the vapour within the condenser 18 causes water to collect in liquid form within the reservoir 25, but outside the capsule 27. Therefore, as the vapour temperature and pressure rise and the capsule 27 shortens, there is space within the reservoir 25 to collect more water. Consequently, the amount of water in circulation through the evaporator 16 and condenser 18 is reduced which reduces the rate of heat transfer from the evaporator 16 to the condenser 18, thus providing a compensating effect for the reduced amount of heat which is required to be withdrawn through the pipe 23. If the capsule 27 is arranged to retract axially to the point where the reservoir 25 will accommodate all the liquid in the heat pipe 15, at a given temperature, transfer of heat thereby will be virtually stopped at that temperature.

The liquid in the heat pipe 15 is chosen such that its boiling point, at the relevant working pressure within the condenser 18, is only a little above the maximum required temperature for the water leaving the pipe 23. Thus, the heat source is easily able to evaporate the liquid arriving in the evaporator 16. The result is that the heat transferred is insensitive to the temperature of the bricks 11 and plates 13, which can vary widely over time with little effect. Furthermore the operating pressure is much closer to the vapour pressure of the working fluid at the temperature of the condenser 18 than at the temperature of the evaporator 16, so the pressure is also insensitive to the temperature of the bricks 11 and plates 13. Therefore, a much more volatile working fluid can be safely used than would normally be permitted by the envisaged maxmum of the temperature of the bricks 11 and plates 13.

The large surface area of the condenser 18 in contact with the water in the tank 21 ensures that the temperature at which the water condenses in the condenser 18 is higher than the temperature of the water in the tank 21 by a modest amount, this is necessary for stable operation of the heat pipe 15.

It is convenient to arrange the capsule 27 such that it displaces as much as possible of the liquid out of the reservoir 25 when the pressure in the condenser 18 is around 0.4 an atmosphere absolute. It is also arranged to allow the reservoir 25 to collect all of the liquid (typically only a few cubic centimeters) when the pressure is around 0.85 atmosphere absolute. The heat pipe 15 therefore transfers a maximum quantity of heat (several hundred watts to a few kilowatts) up to a radiator water temperature of about 75 degrees C., and then progressively less until the heat transfer is zero at around 95 degrees C. If there is no water flow around the condenser 18, the stagnant water reaches 95 degrees C. and nothing further happens until cooler water enters from the radiators.

FIG. 2 shows an alternative to the upper part of FIG. 1 in which the bellows 27A is arranged to sense the difference in pressure between the condenser 18A and the pressure of the water in the tank 21A, which will generally be a small fixed amount above atmospheric pressure. For this purpose, the interior of the bellows 27A is vented through loose fitting cylindrical guide elements 28, 29 to the interior of the condenser 18A, whilst the whole of the capsule is immersed in the water in the tank 21A.

In further, unshown, embodiments, the bellows capsule 27 may respond to the difference between the pressure in the condenser 18 and atmospheric pressure, by locating the bellows capsule 27 in the air external of the tank 21. In addition to the automatic regulation of temperature of the water leaving the pipe 23, the actual temperature achieved can be adjusted by applying an appropriate external axial force to the bellows 27, for example through a spring. Alternatively, the relative axial location of the reservoir 25 and capsule 27 in FIG. 1 can be adjusted, so as to change the pressure in the condenser 18 at which all of the liquid becomes trapped in the reservoir 25.

Figure 3:
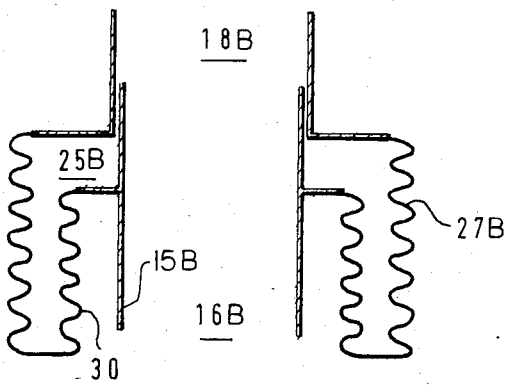
FIG. 3 is a section showing another alternative to part of FIG. 1.

In FIG. 3 the reservoir 25B is formed partly between the bellows capsule 27B and a further coaxial bellows capsule 30. The capsules 27B and 30 are sealed together at the bottom whilst the capsule 27B is sealed at the top to the condenser 18B and capsule 30 is sealed at the top to the evaporator 16B. The upper part of the evaporator 16B fits within the lower part of the condenser 18B, with a small gap, so that liquid condensed on the walls of the condenser 18B trickles down through the gap and maintains the reservoir 25B full of liquid, to the level of the top edge of the evaporator 16B. In this embodiment, when the operating pressure increases, more room for liquid is created in the reservoir 25 so that the amount of liquid in circulation is reduced rapidly, the mechanism being the flow of all the condensed liquid into the reservoir 25B, rather than the flow of some condensed liquid and condensation of vapour therein.

All the arrangements described above ensure that the corrugations of the bellows are beneath the level of the liquid in the reservoir. If they are not, liquid can then condense in the corrugations and become trapped there.

The variation of heat transfer with radiator water temperature, and the stability of operation of the heat pipe 15 can be altered by arranging that the component which displaces liquid from the reservoir 25 and/or the reservoir 25 itself have horizontal cross-sectional areas which vary with height.

The sensitivity of heat transfer to the temperature of the bricks 11 could be further reduced by various means, for example, spiral grooves in or wires on the wall of the evaporator 16 or multiple circular corrugations in the wall of the condenser 18, forcing the liquid film to flow at a small angle to the horizontal, thus slowing the flow and increasing the water content of the condenser 18.

An alternative use to the system described above, instead of transferring heat from high temperature bricks 11 to water in a tank 21, is where it is required to maintain an object or a space at a given temperature against variable heat losses. The object or space is connected in thermal contact with the condenser 18 of the heat pipe 15 of the type described above. Heat can be applied to the evaporator 16 through a simple on-off control which would cause the temperature surrounding the evaporator 16 to rise and fall significantly. However, for the reasons explained above, the object or space would approach the desired temperature smoothly and would tend to stay at that temperature.

In the embodiments described above, the condenser 18 is located above the evaporator 16, so that condensed liquid can flow under gravity down to the evaporator 16. Other dispositions of the components may be utilised if the condensed liquid is returned from the condenser 18 to the evaporator 16 by means of capillary action, such as by the use of a wick or porous means as is well-known in heat pipes.

In all the above embodiments the quantity of fluid in the heat pipe 15 is so chosen that the liquid running down the wall of the evaporator 16 is evaporated before it reaches the bottom. The heat transfer from the evaporator 16 to the condenser 18 is therefore determined by the rate at which the liquid film can fall from the condenser 18 to the evaporator 16. The small diameter evaporator 16 means that, for any given quantity of water in circulation, the thickness of the water film and therefore the heat transfer are less sensitive to brick temperature than they would be if the evaporator 16 were as large as the condenser 18. This is because only a small fraction of the water in circulation is in the evaporator 16.

Figure 4:
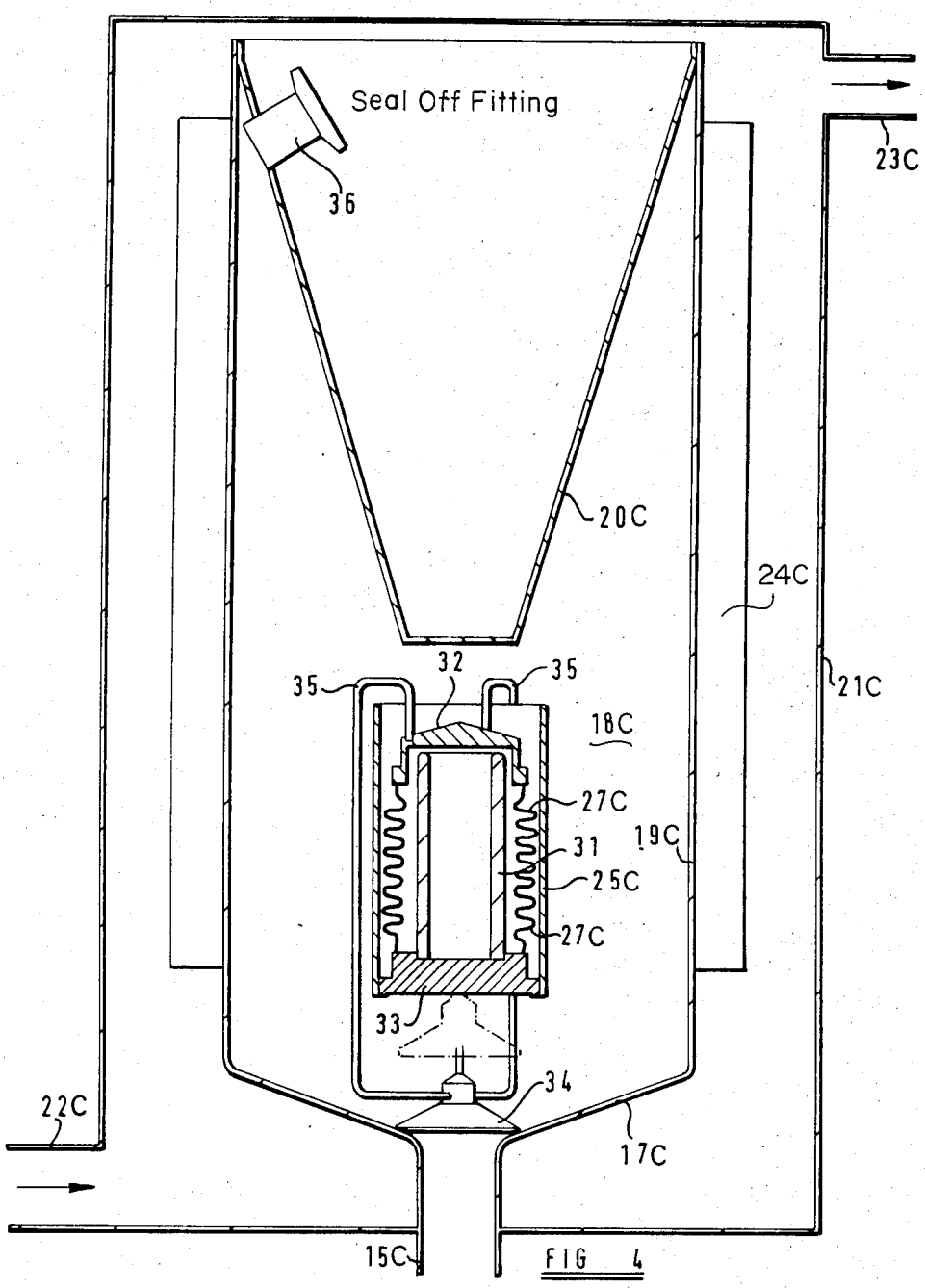
FIG. 4 is a section showing another alternative to part of FIG. 1.

In FIG. 4, the top wall 20C of the condenser 18C has a downwardly convergent conical form, so that vapour condensing on the wall 20C runs downwardly and inwardly to fall into the reservoir 25C which is rigidly fastened to the condenser 19.

Within the reservoir 25C, a bellows capsule 27C has its ends sealed respectively to a cap 32 and the base 33 of the reservoir 25C. As the pressure within the condenser rises the capsule 27C shortens until the tube 31 rests on base 33 and the cap 32 abuts the top end of the tube 31. When the cap 32 is thus fully lowered towards the base 33, a shield 34, suspended by 3 rods 35 from the cap 32, is arranged to just close the upper part of the heat pipe 15C, to prevent heat transfer by convection of water vapour.

As the pressure in the condenser 18C falls, the cap 32 will rise, which in turn raises the shield 34, to restore full flow of vapour between the heat pipe 15C and condenser 18C.

The interior of the condenser 18C is evacuated and charged with water through a vacuum seal-off fitting 36.

In FIG. 4 the outlet pipe 23C is below the level of the top of the wall 20C. During steady operation of the system most of the heat transfer occurs through the side walls 19C of the condenser 18 and the heat exchange surfaces 24C. Thus most of the condensate will form on the side walls and not pour into the reservoir 25C. However, when the temperature of the water in the tank 21C starts to rise, the temperature of the water within the conical wall 20C, being somewhat isolated from the main stream leaving by the outlet 23C, will lag behind so that condensate continues to form thereon and runs into the reservoir 25C, which will have had its capacity increased by compression of the bellows capsule 27C in response to the increased pressure in the heat pipe 15C.

What is claimed is:

1. In a liquid heating system for heating a first liquid, said system including a heat store to be heated to a relatively high temperature by off-peak electricity, and said heat store being thermally connected to a vessel containing the first liquid to be heated to a temperature lower than said relatively high temperature, wherein the improvement comprises a controllable heat pipe providing said thermal connection, the heat pipe including an evaporator zone in thermal contact with the heat store and a condenser zone in thermal contact with the vessel, the zones joined by at least one duct, the evaporator zone, condenser zone and the at least one duct being hermetically sealed and containing a predetermined quantity of a volatile second liquid, arranged so that after the second liquid is evaporated in the evaporator zone, it passes through said at least one duct to the condenser zone where it is condensed, and from whence the second liquid returns to the evaporator zone through said at least one duct, the quantity of second liquid being chosen to be sufficiently small so that, in use, the rate of heat transfer from the evaporator zone to the condenser zone is determined by the rate of return flow of the second liquid towards the evaporator zone rather than the rate of flow of the evaporated second liquid towards the condenser zone, or the rate of heat transfer to the evaporator zone or from the condenser zone, and control means being provided directly responsive to the pressure of the evaporated second liquid in said condenser zone for controlling the rate of return flow of the second liquid to the evaporator zone.

2. In a liquid heating system according to claim 1, in which the control means is arranged to collect a predetermined volume of the second liquid, said control means being responsive to the pressure within the condenser zone to vary the volume of second liquid collected, so as to reduce the amount of second liquid circulating in the heat pipe as the pressure therein rises.

3. In a liquid heating system according to claim 2, wherein said control means includes reservoir means positioned to collect said second liquid up to a predetermined level, and means to alter the volume of the second liquid in the reservoir means in response to changes in pressure in the condenser zone.

4. In a liquid heating system, according to claim 3 in which the wall of the condenser zone above the reservoir is of downwardly convergent shape, whereby condensate forming thereon will run down and drop into the reservoir.

5. In a liquid heating system according to claim 3, in which the reservoir means includes a sealed capsule which contracts in volume as the pressure in the condenser zone rises.

6. In a liquid heating system as in claim 1, in which the heat store comprises a mass of solid material heated by an electrical resistance element.

7. In a liquid heating system, according to claim 6, in which the solid material is in the form of bricks.

8. In a liquid heating system according to claim 6 including metal fins in thermal contact with the evaporator zone, the fins extending among the solid material.

9. In a liquid heating system according to claim 8, in which the fins are cast iron plates.

10. In a liquid heating system as in claim 1, in which the outside of the condenser zone, within the vessel, is provided with heat exchange fins.

11. In a liquid heating system as in claim 1, in which the first liquid is water and the vessel is adapted to be connected into a hot water central heating system.

12. In a liquid heating system as in claim 1, in which the outside of the condenser zone, within the vessel, is provided with heat exchange corrugations.

* * * * *